US012029261B1

(12) United States Patent
Englebrecht et al.

(10) Patent No.: US 12,029,261 B1
(45) Date of Patent: Jul. 9, 2024

(54) GARMENT WITH INTEGRATED MAMMARY SUPPORT SYSTEM AND RELATED METHODS

(71) Applicants: Kris Englebrecht, Auburn, CA (US); William Nelson, Auburn, CA (US)

(72) Inventors: Kris Englebrecht, Auburn, CA (US); William Nelson, Auburn, CA (US)

( * ) Notice: Subject to any disclaimer, the term of this patent is extended or adjusted under 35 U.S.C. 154(b) by 0 days.

(21) Appl. No.: 18/528,811

(22) Filed: Dec. 5, 2023

(51) Int. Cl.
*A41C 3/08* (2006.01)
*A41D 1/22* (2018.01)

(52) U.S. Cl.
CPC ..... *A41C 3/08* (2013.01); *A41D 1/22* (2013.01); *A41D 2200/10* (2013.01); *A41D 2300/324* (2013.01)

(58) Field of Classification Search
CPC ..... A41C 3/08; A41D 2300/32; A41D 200/10
USPC ..... 450/30–33
See application file for complete search history.

(56) References Cited

U.S. PATENT DOCUMENTS

| | | | | |
|---|---|---|---|---|
| 3,628,539 | A | 12/1971 | Fredricks | |
| 4,412,542 | A | 11/1983 | Reichert | |
| 6,059,633 | A * | 5/2000 | Currier | A41C 3/08 450/11 |
| 6,185,743 | B1 | 2/2001 | Mick | |
| 7,257,847 | B2 | 8/2007 | Hart | |
| 7,258,593 | B2 | 8/2007 | Mineconzo | |
| 7,396,272 | B1 | 7/2008 | Newlen | |
| 8,403,724 | B1 * | 3/2013 | Chapin | A41C 3/08 450/32 |
| 9,179,716 | B2 | 11/2015 | Forbes et al. | |
| 10,595,569 | B2 * | 3/2020 | Oguchi | A41C 3/144 |
| 10,709,182 | B1 | 7/2020 | Healy et al. | |
| 11,019,861 | B2 | 6/2021 | Picot | |
| 2006/0218692 | A1 | 10/2006 | Lamarque | |
| 2014/0123362 | A1 | 5/2014 | Seitz et al. | |
| 2015/0033439 | A1 | 2/2015 | Dimotsantos | |

(Continued)

FOREIGN PATENT DOCUMENTS

| | | | |
|---|---|---|---|
| CN | 201178704 | Y | 1/2009 |
| CN | 206612248 | U | 11/2017 |

(Continued)

OTHER PUBLICATIONS

Austin Moms, Being in the Boob Business With the Brobe, Obtained on Sep. 26, 2023, Available Online: "https://austinmoms.com/2014/05/20/the-brobe/".

(Continued)

*Primary Examiner* — Gloria M Hale
(74) *Attorney, Agent, or Firm* — Sierra IP Law, PC; William K. Nelson

(57) ABSTRACT

A robe garment provided with an integrated mammary support incorporates support system is provided. The robe may be operable to envelop a torso and features a front and a strategically positioned posterior opening. The support system includes bilateral mammary cups, each tethered to a respective cable. These cables are conjoined to belts emanating from the robe's posterior opening and the actuation of these belts facilitates breast elevation, thereby providing tailored support. Additionally, the robe is equipped with interior guide loops for precise cable navigation, exterior belt loops for belt alignment, and a concealing rear cover to enhance aesthetics and ensure user privacy.

19 Claims, 7 Drawing Sheets

(56) References Cited

U.S. PATENT DOCUMENTS

| | | | |
|---|---|---|---|
| 2016/0309799 | A1 | 10/2016 | Nysheva-Starr |
| 2018/0070656 | A1 | 3/2018 | Morency |
| 2019/0116890 | A1 | 4/2019 | Poirier |
| 2020/0068708 | A1 | 2/2020 | Longinotti-Buitoni et al. |
| 2020/0113257 | A1 | 4/2020 | Winner |
| 2020/0383403 | A1 | 12/2020 | McGrath |
| 2021/0186127 | A1 | 6/2021 | Rosenberg |
| 2022/0338566 | A1 | 10/2022 | McGregor et al. |
| 2023/0022543 | A1 | 1/2023 | Brito et al. |
| 2023/0337767 | A1 | 10/2023 | Cook |

FOREIGN PATENT DOCUMENTS

| | | | |
|---|---|---|---|
| CN | 114794620 | A | 7/2022 |
| WO | 2022235489 | A1 | 11/2022 |

OTHER PUBLICATIONS

English abstract of foreign patent document CN114794620A, available online: "https://worldwide.espacenet.com/patent/search/family/082516526/publication/CN114794620A?q=pn%3DCN114794620A".

English abstract of foreign patent document CN201178704Y, available online: "https://worldwide.espacenet.com/patent/search/family/040248208/publication/CN201178704Y?q=pn%3DCN201178704Y".

English abstract of foreign patent document CN206612248U, available online: "https://worldwide.espacenet.com/patent/search/family/060236366/publication/CN206612248U?q=pn%3DCN206612248U".

* cited by examiner

GARMENT WITH INTEGRATED MAMMARY SUPPORT SYSTEM AND RELATED METHODS

FIELD OF THE INVENTION

The present invention relates generally to a nighttime garment integrated with a mammary support system. More specifically, the mammary support system includes a pair of cups, each having an independent chord driven adjustment system that is operable to position and provide support tailored to each breast of an individual. The cord-enabled adjustment system of the present invention is operably integrated into the belt and closing mechanism of the robe and simultaneously provides mammary support and concealment of the breasts.

BACKGROUND OF THE INVENTION

Traditional night garments or robes are typically designed for general coverage and comfort, without specific considerations for breast support. This lack of support can lead to discomfort, especially for individuals with larger breasts. The absence of support can cause strain on the back and shoulders, leading to discomfort or pain. Most robes follow a universal design, not accounting for the varying shapes and sizes of breasts. Without adequate breast support, traditional robes restrict the range of activities comfortably undertaken while wearing them. Activities that require bending or moving briskly can be particularly uncomfortable, and robes often have loose openings at the front, which can inadvertently expose the chest area, leading to privacy concerns. This is particularly an issue in shared living spaces or in scenarios in which more modesty is desired. For additional support, wearers often need to layer a bra or other support garment under the robe. This layering can be cumbersome and counterintuitive to the robe's purpose of providing easy-to-wear, relaxed clothing.

There are no garments available on the market that address the above mentioned shortcomings of nighttime garments, robes, and lounge wear. There exists a long felt need for a robe garment that incorporates a mammary support system.

SUMMARY OF THE INVENTION

The present invention provides a robe garment with an integrated breast support system. The integration of a mammary support system involves the incorporation of supportive elements similar to those found in brassieres, tailored to a traditional robe style and common fabrics. The present invention offers enhanced comfort, better mammary fit, and increased functionality, making robes more suitable for a wider range of activities and users. Additionally, it operably addresses privacy concerns by providing secure coverage. The present invention significantly enhances the utility and comfort of robes, especially for those seeking additional chest support without sacrificing the ease and comfort of a robe.

In an exemplary embodiment of the present invention a garment, provided as a robe, night gown, or lounge wear may have an opening from a neck forming portion to a region below the waist of an individual. The garment may include an exterior surface with belt loops positioned around the waist and an interior surface with a plurality of alignment loops (e.g., guide loops) that are operable to position the cables of a mammary support system.

The mammary support system of the present invention may include a right cup corresponding to a right breast and a left cup corresponding to a left breast, each of the cups may have an adjustment cable (e.g., cord, drawstring, ribbon, etc.) that is in communication with an oppositely positioned belt. For example, a right cup may have a cable that is connected to a left side belt and a left cup may have a cable that is connected to a right side belt. When an individual engages the belts, the cups may raise corresponding to the level of clinching stress or tension imparted on the corresponding belt.

In some embodiments, the mammary support system may include guides and loops provided along an interior surface of the garment that are configured with an orientation and conduit structure that is operable to guide the cables along a predetermined path. The position of the guides and loops may be along the general shape of a shoulder to the lower waist of an individual. An aperture may be provided at the center rear that provides an opening and a passage for the cables to pass up the back portion of the garment, allowing them to be routed over the shoulders.

It is an aspect of the present invention to provide a mammary support garment, the garment may include, a robe configured to cover at least a portion of the torso of a user, the robe may have an interior surface, exterior surface, a front opening extending from a neck region to a lower portion of the robe, and a central opening at the backside near the waist of a user. The robe may include a mammary support system integrated into the robe that may include a right and left side cup positioned within the robe at locations corresponding to the mammary region of the user.

The garment may include a plurality of belt loops or a channel secured to the exterior or interior surface of the garment and along the user's waist for guiding the belt. The right-side cable path and a left side cable path crisscross and may provide lateral and longitudinal adjustment to the cups. A cable having a first end secured to a top portion of the cup and a second end operatively secured to a belt, wherein the right-side cup corresponds to a left-side belt and the left side cup corresponds to a right-side belt. The left-side belt and right-side belt pass through a central opening at the rear aspect of the robe and pass through a channel or loops up the back of the garment. The central opening may be located on the interior or exterior of the rear aspect of the garment. The garment may include a rear cover that may be operable to conceal the central rear opening in embodiments where the central opening is on the exterior of the garment. The mammary support system may be operable to receive a user's breast in the cups, and when cinching the left-side belt and right-side belt around the user's waist, the cups may raise a user's breasts to provide mammary support.

It is a further aspect of the mammary support system, to provide a mammary support system that includes a plurality of guide loops secured to the interior surface, and the plurality of guide loops may be operable to route the cable to a central opening in the rear aspect of the garment. Additional guide loops or channels may provide a passage for the cables up through the rear aspect of the garment that corresponds to the area of the spine and then over the shoulders and down to positions on superior aspects of the cups. In some embodiments, the cables may have one or more nodes at their distal ends near the cups creating branching in the cable so that each cable can be attached to the corresponding cup at more than one point on an upper aspect of the cup. In some embodiments, the branching cable may be attached at upper portions, lateral portions, and/or lower portions of the cup. The guide loops may be operable to route the cable along a path that reaches the cups and allows adjustment of the level of the cups and mammary support by the wearer. In some embodiments, the mammary support system may be concealed behind a layer of material, such that the exterior of the garment and the interior surface of the garment sandwich the support system. In such embodiments, the support system is not in direct contact with the skin, thereby eliminating potential rashes and rubbing of the wearer's skin.

The right- and left-side cups may be attached to the interior surface of the robe with a fastening mechanism. The fastening mechanism may be a plurality of stitches along the periphery of the cups sewn into the interior surface of the robe. The cables may have an attachment mechanism that is operable to temporarily secure the cables at a position on the cup. The cups may also be removable and replaceable allowing for the insertion of a cup that corresponds to a user's breast size using the attachment mechanism.

It is another aspect of the present invention to provide a mammary support garment that may include a robe configured to envelop at least a portion of the torso of a user, incorporating an interior surface, an exterior surface, a front opening extending from a neck region to a lower end of the robe, and a central opening positioned at the rear aspect of the garment at the waist of a user. An integrated mammary support system that may include a right- and left-side mammary cup positioned within the interior surface of the robe at locations corresponding to the mammary region of the user, and a pair of cables, each having a first end attached to the top edge of a respective mammary cup, and a second end functionally connected to a belt system positioned at the central opening, where the right side mammary cup links to the left side belt and the left side mammary cup to the right side belt; and a plurality of guide loops or channels attached to the interior surface of the robe arranged to direct the cables towards the central opening and facilitate the adjustable positioning of the mammary cups.

The mammary support system may be operable to accommodate a user's breasts in the mammary cups, and a cinching of the left- and right-side belts around the user's waist causes an elevation of the user's breasts for mammary support. The central opening may be concealed with a rear cover operable to provide privacy to the user. The mammary cups may be affixed to the interior surface of the robe via a fastening mechanism. The fastening mechanism may be provided as a snap fastener sewn onto both the garment and bra cup, and the snap fasteners may be operable to interlock and provide a discreet and secure hold. The pair of cables attached to edges of a respective mammary cup may include a snap fastener sewn to both the mammary cup and the cable's first end. The snap fastener may be able to engage and disengage, providing access to remove and replace the mammary cup.

It is another aspect of the present invention to provide a method for supporting breasts using a mammary support garment, the method may include the steps of: providing a robe with an integrated mammary support system, which may include the robe may have an interior surface, an exterior surface, a front opening, and a central opening positioned at the rear of the garment at the waist of a user, and a the mammary support system may include a right and left side cup secured to the interior surface, each of the cups may be attached to a cable that may be in communication with a belt, wherein the belt may be positioned at the central opening, and the right side cup links to a left-side belt and the left-side cup to the right-side belt. A method of use may include donning the robe and positioning each breast of the user into the corresponding right and left side cups of the mammary support system; pulling the left- and right-side belts from the central opening at the back of the robe, thereby adjusting the elevation of the user's breasts, and cinching the belts around the waist of the user; and securing the belts in place once a desired level of mammary support and comfort may be achieved. The belts may be tightened or loosened, thereby adjusting the tension of the cables connected to the cups and consequently altering the level of breast elevation. The mammary support system may include a plurality of guide loops or channels attached to the interior surface of the robe to route the cables from the cups to belts, thereby providing a predetermined path and adjustment to the cups. The method may further include the step of replacing the mammary cups with alternative cup sizes that correspond to the user's breast size before donning the robe.

Further aspects and embodiments will be apparent to those having skill in the art from the description and disclosure provided herein.

It is an object of the present invention to provide a mammary support system that is integrated into a robe garment, the support system being operable to provide adjustable engagement with the breasts of a user, thereby eliminating the need to wear a brassiere.

It is another object of the present invention is to provide a mammary support system integrated into a robe garment that is operable to eliminate pinching between the breasts and back closure pinching and raises the breasts such that sweat accumulation under the breast area is eliminated.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

Figure 1:
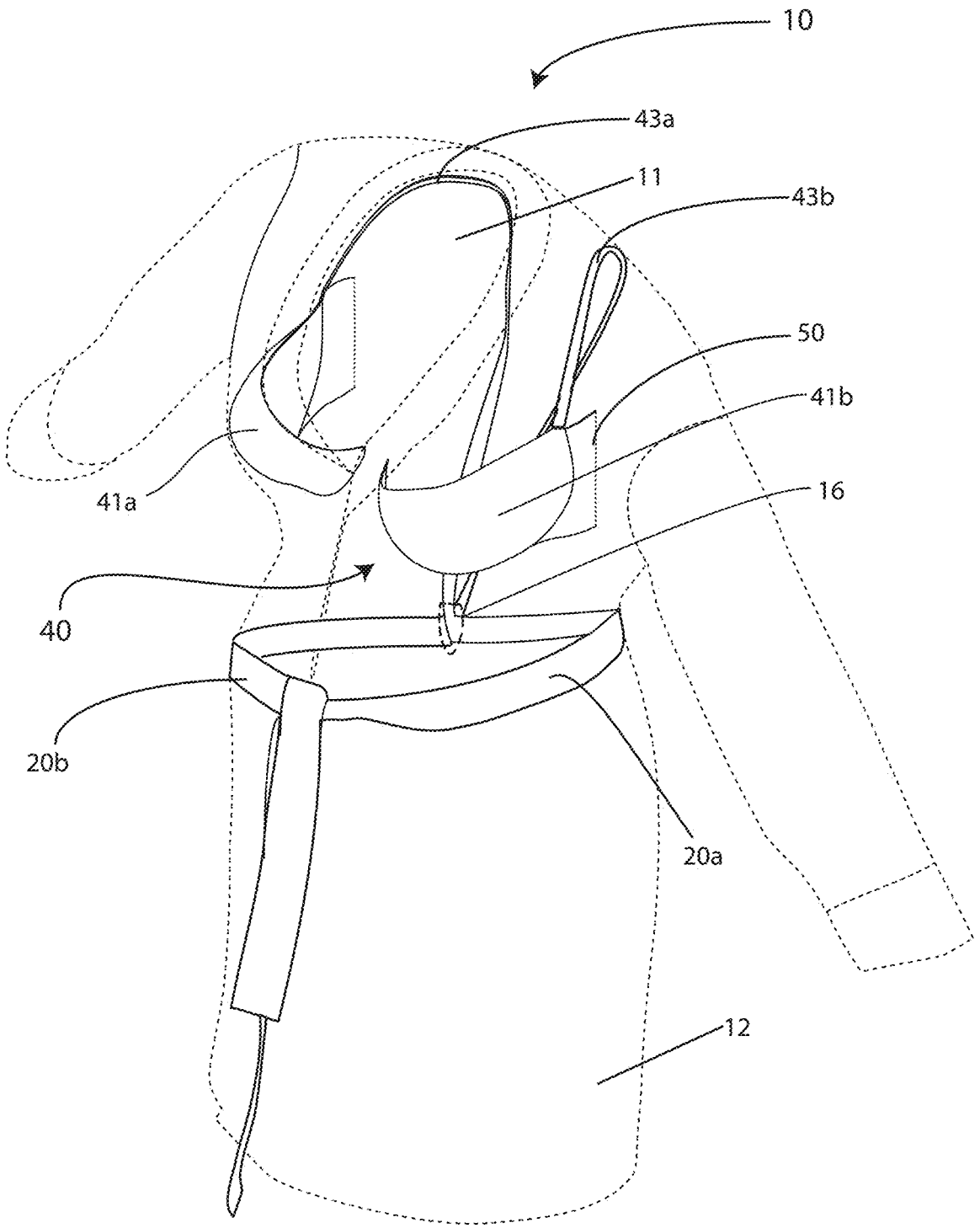
FIG. 1 provides an exemplary perspective view of a robe garment, according to an embodiment of the present invention.
Figure 2:
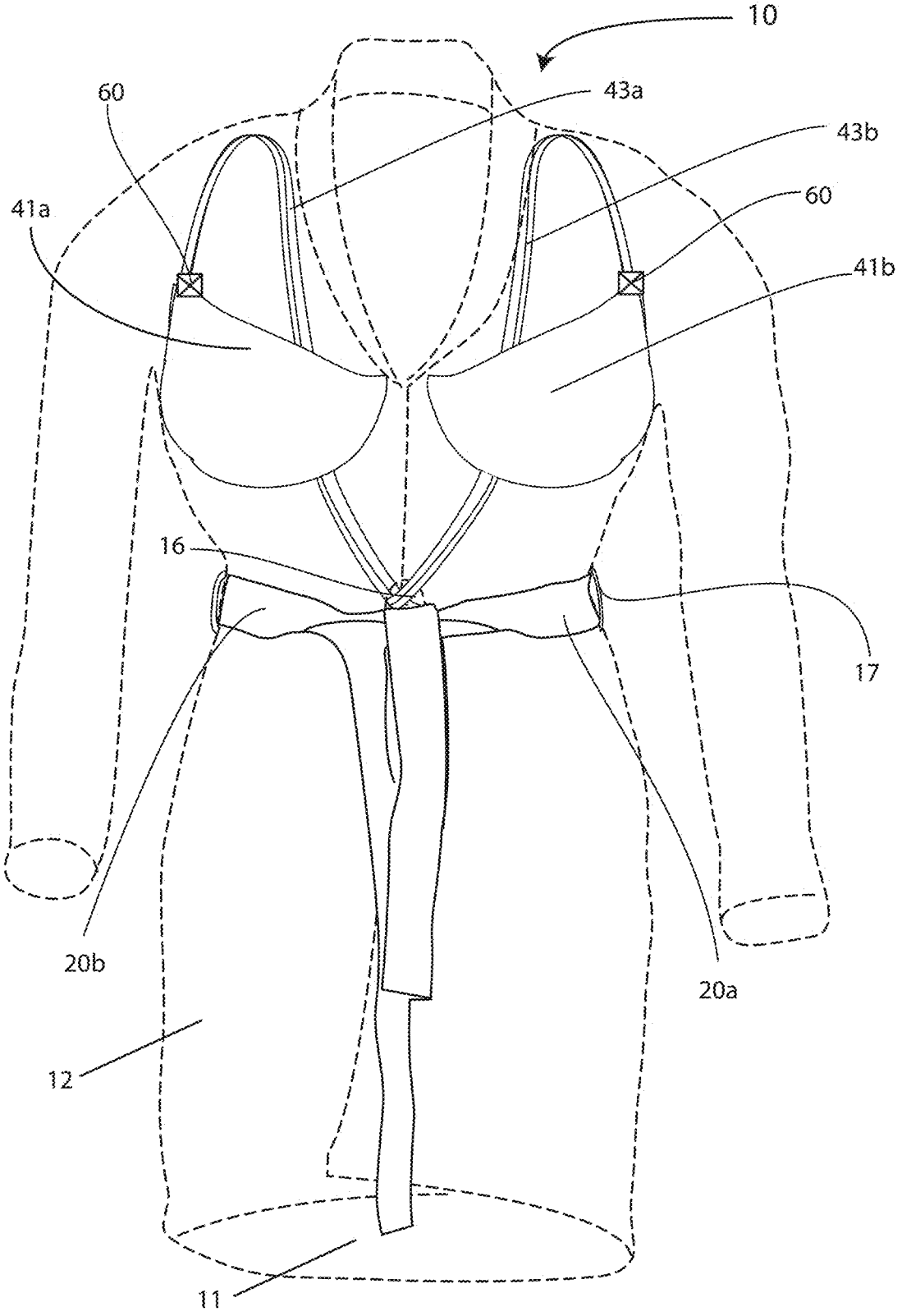
FIG. 2 provides an exemplary front view of a robe garment, according to an embodiment of the present invention.

The drawings are not at scale and present a simplified representation of various features illustrative of the basic principles of the invention. Certain invention features such as dimension, orientation, location, shape and material will be determined by application, size and shape.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Referring to the drawings wherein like reference characters designate like or corresponding parts throughout the several views and referring particularly to the robe garment, herein as, "garment" or "robe" or the like. The garment 10 of FIGS. 1-7, it is seen that in this illustrated embodiment, the garment 10 may include an adjustable mammary support system 40. The garment may include an interior surface 11, an exterior surface 12, and have a front opening extending from a neck region to a lower end of the garment. Throughout the drawings the garment 10 is illustrated using dashed lines providing a transparent view of the mammary support system 40.

Figure 3:
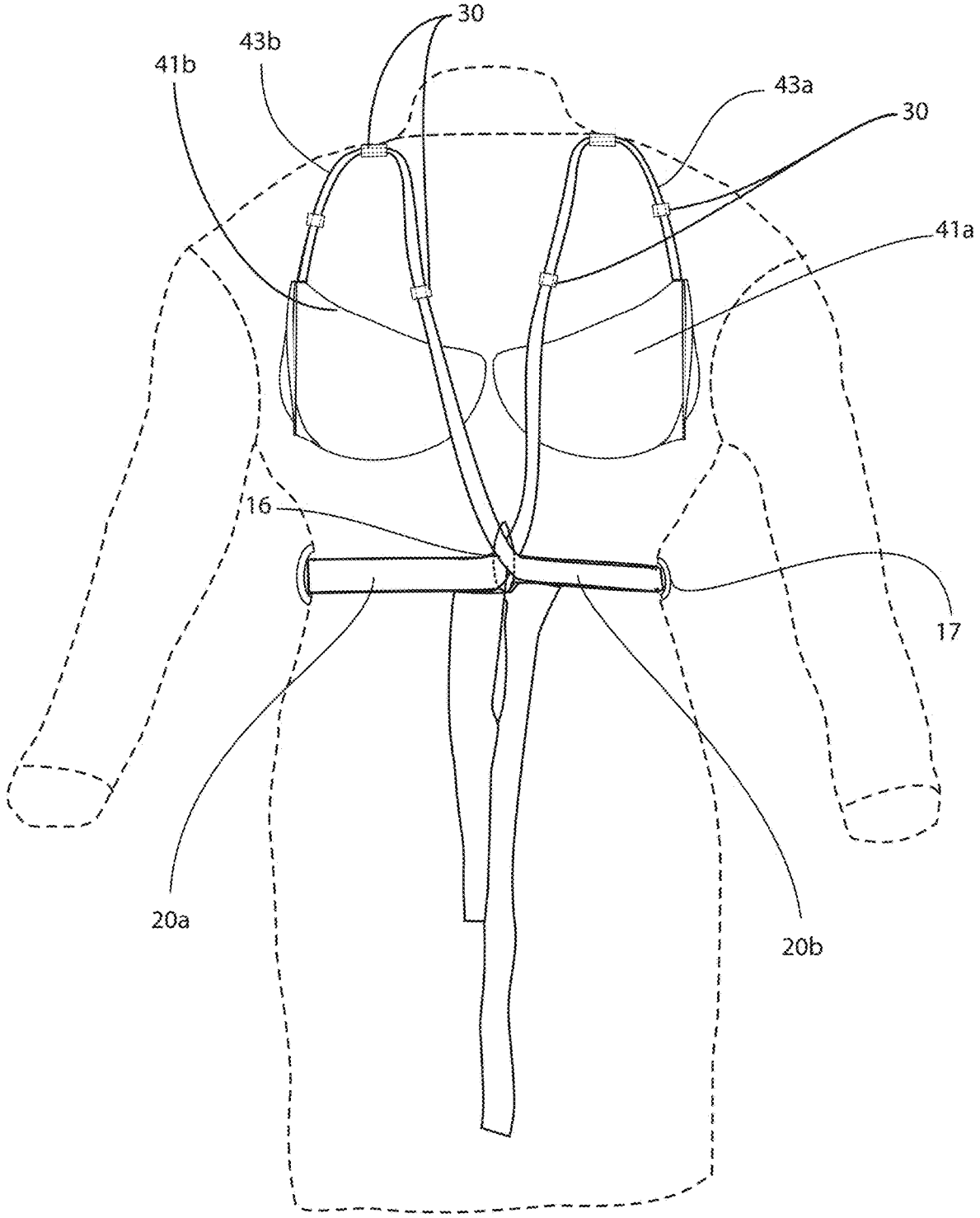
FIG. 3 provides an exemplary rear view of a robe garment, according to an embodiment of the present invention.

The exemplary adjustable mammary support system 40 of the present invention may include a first cup 41*a* corresponding to a right breast, and a second cup 41*b* corresponding to a left breast. Each of the cups 41*a*, 41*b* may include a cable 43*a*, 43*b* secured to a top end of the corresponding cup. The cables 43*a*, 43*b* may route over the shoulder through loops or channels and wrap around the torso of the wearer where they crisscross and connect to an end of a belt wrap 20. The cable 43*a* may attach the first cup 41*a* to the left side of the belt wrap 20*a*, and cable 43*b* may attach the second cup 41*b* to the right side of the belt wrap 20*b*. In some embodiments, as best illustrated in FIGS. 1 and 3, the garment 10 may include an opening 16, wherein the cables 43 are operable to pass through the garment opening 16 and attach to the corresponding belt wrap 20. In some embodiments, the garment exterior surface 12 may have belt loops 17 along the waist for routing the belt wrap 20.

In operation, when an individual dons the garment 10, the mammary support system 40 is operable to provide breast support. The individual's breasts may be positioned in the corresponding cup 41*a*, 41*b* and the amount of breast support may be adjusted by tightening or cinching the belt wrap 20*b* around the exterior surface 12 of the garment 10 and the individual's waist. In some embodiments, the mammary support system 40 may be operable to simultaneously provide support to the breasts and close the opening of the rob garment. In some embodiments, as illustrated in FIG. 3 the cables 43*a*, 43*b*, may be routed through a plurality of loops 30 that are secured to the garments interior surface 11. In some embodiments, the loops 30 may provide a routing path for the cable 43 from the corresponding cup 41 to the rear opening 16. In other embodiments, a conduit (not shown) may be provided in place of the plurality of loops 30 and may provide a routing path for the cables 43. In some embodiments, the routing path may be operable to provide a guide for the cables 43*a*, 43*b* to provide enhanced support to an individual's breasts when the garment is cinched.

Figure 4:
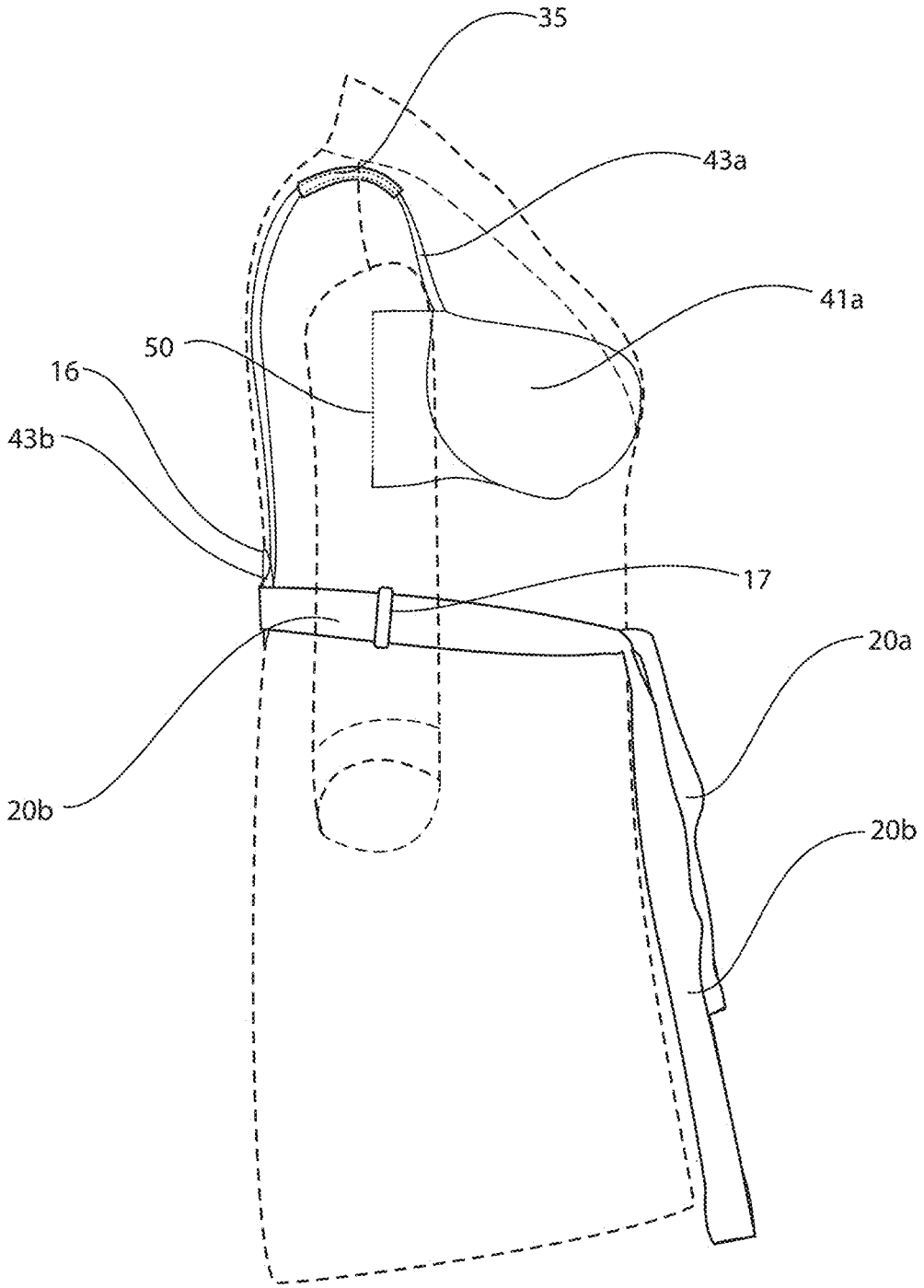
FIG. 4 provides an exemplary first side view of a robe garment, according to an embodiment of the present invention.
Figure 5:
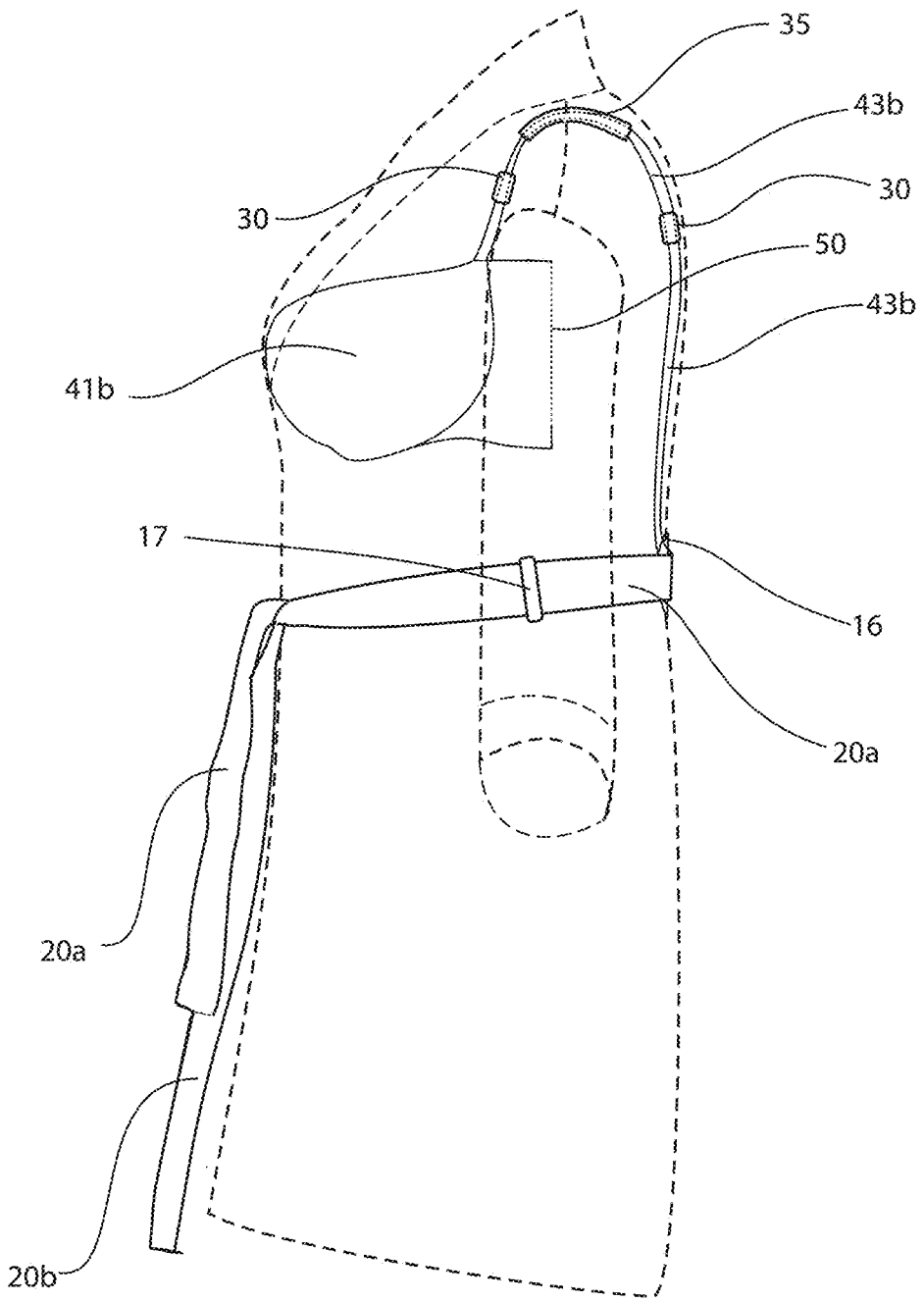
FIG. 5 provides an exemplary second side view of a robe garment, according to an embodiment of the present invention.

In some embodiments, as illustrated in FIG. 4, a single shoulder guide 35 may be provided to route the cable 43*a*, 43*b* from the cups 41*a*, 41*b* to the belt wrap 20*a*, 20*b*. In some embodiments, as illustrated in FIG. 5, a combination of a shoulder guide 35 and a plurality of loops 30 may be incorporated along the interior surface of the garment 10 to rout the cables 43*a*, 43*b*.

Figure 6:
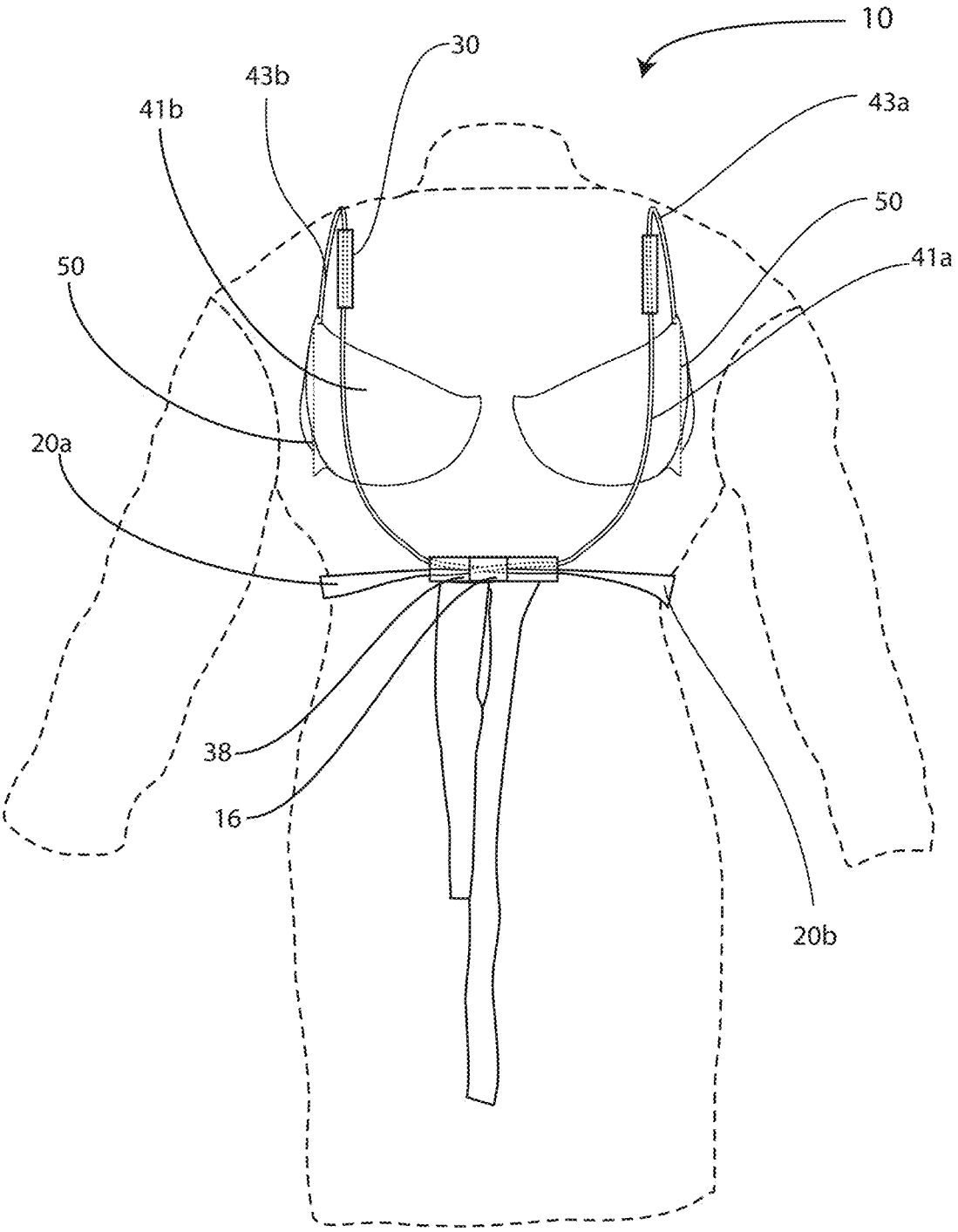
FIG. 6 provides an exemplary second rear view of a robe garment, according to an embodiment of the present invention.
Figure 7:
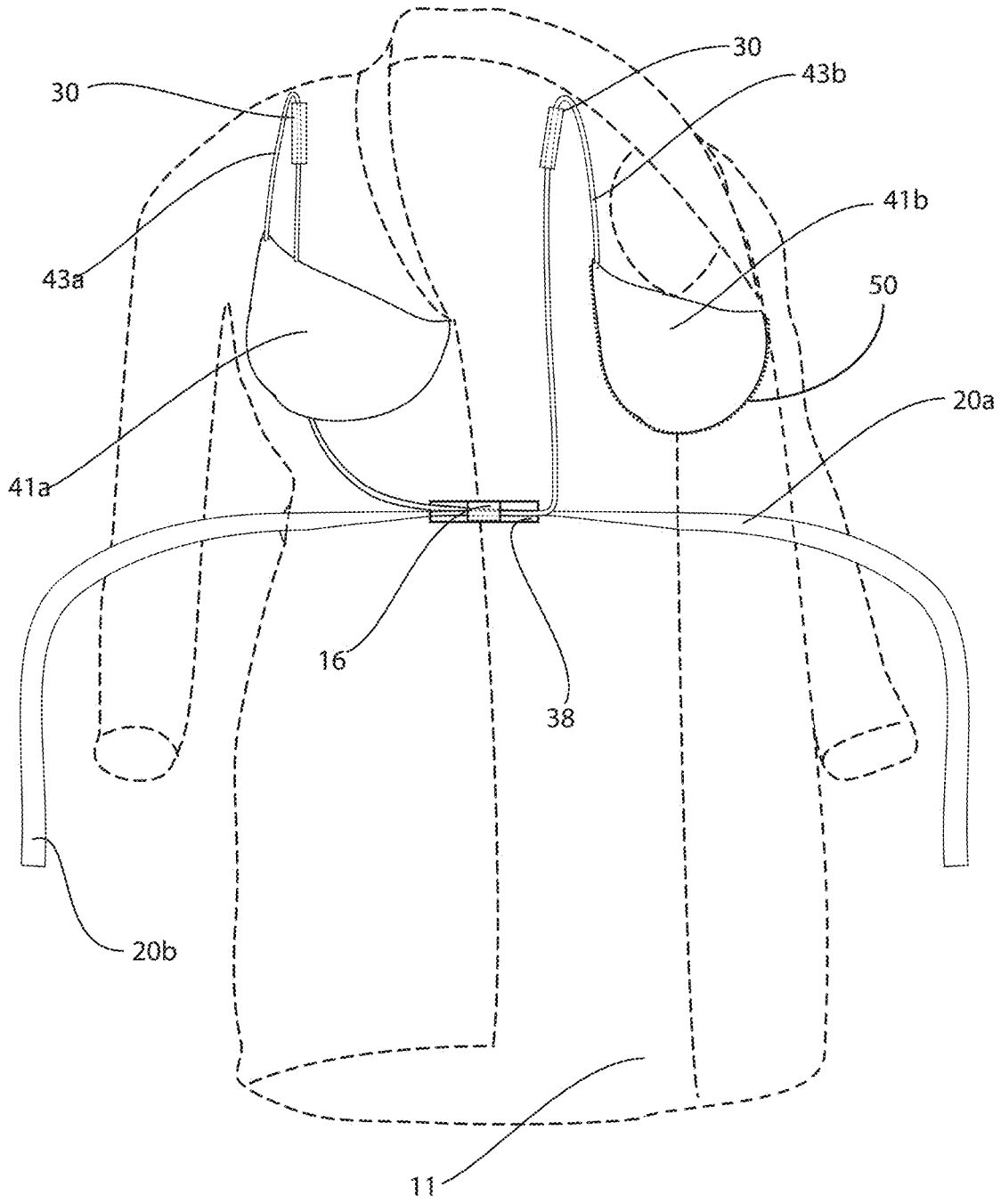
FIG. 7 provides an exemplary front view of a robe garment in a semi open configuration, according to an embodiment of the present invention.

In some embodiments, as illustrated in the exemplary rear view of FIG. 6 and the partially opened view of FIG. 7, a rear cover 38 is positioned over the rear opening 16 and is operable to hide the opening 16 and the cable 43*a*, 43*b* and their connection with the waist belts 20*a*, 20*b* and may prevent excessive abrasion or rubbing with external objects.

The pair of cups 41*a*, 41*b* may be secured to a garment's interior surface 11. In some embodiments, the cups 41*a*, 41*b* may be secured to the garment 10 by sewing or stitching 50 the cups directly to the garments interior surface 11 along the periphery of the cups, the stitching 50 is best illustrated in FIG. 7. In other embodiments, the cups may be secured using an adhesive, hook and loop fasteners, heat bonding, incorporating an elastic band inside the garment, providing a stretchable hold for the bra cup, or using a tunnel or pocket within the garment where the bra cup may slide in or removed as necessary. In other embodiments, snap fasteners may be sewn onto both the garment and the bra cup and interlock providing a discreet and secure hold.

In some embodiments, the cable 43 may be a cord, ribbon, fabric belt, elastic band, leather or faux leather straps, braided cords, or a drawstring. In some embodiments, best illustrated in FIG. 2, the cables 43*a*, 43*b* may have an attachment mechanism 60 that is operable to secure a cable to the corresponding cup 41*a*, 41*b*. In such embodiments, the cups 41*a*, 41*b* may be removable and replaceable and may be replaced with a cup size corresponding to the individual's breast.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A mammary support garment, the garment comprising:

a. a robe configured to cover at least a portion of a torso of a user, the robe having an interior surface, exterior surface, a front opening extending from a neck region to a lower end of the robe, and a central opening at a rear portion of the garment for positioning near a waist of a user;

b. a mammary support system integrated into said robe, the mammary support system comprising:

i. a right side cup and a left side cup positioned within the robe at locations corresponding to a mammary region of the user, ii. a first cable having a first end secured to a top edge of said right side cup and a second end operatively secured to a left side belt, iii. a second cable having a first end secured to a top edge of said left side cup and a second end operatively secured to a right side belt, and iv. wherein said left side belt and right side belt extend out of said central opening; and c. wherein said mammary support system is operable to receive a user's breast in said cups, and when cinching said left side belt and right side belt around a waist, said cups raise a user's breasts to provide mammary support.

2. The garment of claim 1, wherein said mammary support system is further comprises a plurality of guide loops secured to said interior surface, wherein said plurality of guide loops are operable to route said right side and left side cables to said central opening.

3. The garment of claim 2, wherein said plurality of guide loops are operable to route said right side and left side cables along a path that provides said cups with an adjustable region operable to allow said user to configure said mammary support.

4. The garment of claim 3, wherein said right side cup and said left side cup are each attached to said interior surface of said robe with a fastening mechanism.

5. The garment of claim 4, wherein said fastening mechanism is a plurality of stitches along a periphery of said cups sewn into the interior surface of said robe.

6. The garment of claim 5, wherein said robe further comprises a plurality of belt loops secured to said exterior surface and along the waist for guiding said belt.

7. The garment of claim 3, wherein a right side cable path and a left side cable path crisscross and provide lateral and longitudinal adjustment to said cups.

8. The garment of claim 1, wherein said right side cable further comprises an attachment mechanism that is operable to temporarily secure said right side cable to said cup.

9. The garment of claim 8, wherein said right side cup is removable and replaceable with a cup corresponding to a user's breast size.

10. The garment of claim 1, further comprising a rear cover that is operable to conceal said central rear opening.

11. A mammary support garment, the garment comprising:

a. a robe configured to envelop at least a portion of a torso of a user, incorporating an interior surface, an exterior surface, a front opening extending from a neck region to a lower end of the robe, and a central opening positioned at a rear portion of the garment for positioning at a waist of a user;

b. an integrated mammary support system, comprising:

i. right and left side mammary cups positioned within said interior surface at locations corresponding to a mammary region of the user, and ii. a pair of cables, each having a first end attached to a top edge of a respective mammary cup, and a second end functionally connected to a belt system deposited at said central opening, where the right side mammary cup links to a left side belt and the left side mammary cup to a right side belt; and c. a plurality of guide loops attached to the interior surface of the robe arranged to direct the cables towards the central opening and facilitate adjustable positioning of said mammary cups;

wherein said mammary support system is operable to accommodate a user's breasts in said mammary cups and a cinching of the left side belt and the right side belt around the waist causes an elevation of the user's breasts for mammary support.

12. The garment of claim 11, wherein said central opening is concealed with a rear cover operable to provide privacy to the user.

13. The garment of claim 12, wherein said mammary cups are affixed to the interior surface of said robe via a fastening mechanism.

14. The garment of claim 13, wherein said fastening mechanism is provided as a snap fastener sewn onto both said garment and bra cup, said snap fasteners are operable to interlock and provide a discreet and secure hold.

15. The garment of claim 14, wherein said pair of cables, each having a first end attached to the top edge of one of said mammary cups, and further comprises a snap fastener sewn to both said mammary cup and said cable first end, and said snap fastener is operable to engage and disengage, thereby providing access to remove and replace said mammary cup.

16. A method for supporting breasts using a mammary support garment, the method comprising:

a. providing a robe with an integrated mammary support system, comprising:

i. said robe includes an interior surface, an exterior surface, a front opening, and a central opening positioned at a rear portion of the garment for positioning near a waist of a user, and ii. said mammary support system includes a right side cup and a left side cup secured to said interior surface, each of said cups is attached to a cable that is in communication with a belt, wherein said belt is deposited at said central opening, and said right side cup links to a left side belt and the left side cup to a right side belt;

b. donning the robe and positioning each breast of said user into the corresponding right and left side cups of said mammary support system;

c. pulling the left side belt and the right side belt from said central opening at the rear portion of said robe, thereby adjusting the elevation of user's breasts; and d. cinching the left side belt and right side belt around the waist and securing said left side belt and right side belt in place once a desired level of mammary support and comfort is achieved.

17. The method of claim 16, wherein cinching said belts, includes tightening or loosening the left side belt and right side belt, thereby adjusting tension of the cables connected to the cups and consequently altering a level of breast elevation.

18. The method of claim 17, wherein said mammary support system is further comprises a plurality of guide loops attached to said interior surface of said robe to route the cable from the cups to belts, thereby providing a predetermined path and adjustment to said cups.

19. The method of claim 18, further comprising replacing the mammary cups with alternative cups that correspond to a breast size of the user's before donning the robe.

* * * * *